United States Patent [19]

Stumpp

[11] 4,114,579

[45] Sep. 19, 1978

[54] FUEL-AIR-MIXTURES CONTROLLER FOR INTERNAL COMBUSTION ENGINES

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 746,045

[22] Filed: Nov. 30, 1976

Related U.S. Application Data

[62] Division of Ser. No. 551,498, Feb. 20, 1975, Pat. No. 4,015,571.

[51] Int. Cl.[2] ..... F02M 39/00

[52] U.S. Cl. ..... 123/139 AW; 123/139 BG; 123/119 R; 261/44 A

[58] Field of Search ..... 123/139 AW, 139 BC, 123/119 R; 261/44 R, 44 A

[56] References Cited

U.S. PATENT DOCUMENTS

| | | | |
|---|---|---|---|
| 1,839,102 | 12/1931 | Kessel | 261/44 A |
| 3,320,938 | 5/1967 | Homfeld et al. | 123/119 R |
| 3,739,762 | 6/1973 | Jackson | 123/139 AW |
| 3,842,813 | 10/1974 | Eckert | 123/139 AW |
| 3,880,125 | 4/1975 | Kammerer et al. | 123/139 AW |
| 3,919,992 | 11/1975 | Eckert | 123/139 AW |
| 3,983,849 | 10/1976 | Stumpp | 123/139 AW |
| 4,040,405 | 8/1977 | Panrka et al. | 123/139 AW |
| 4,043,307 | 8/1977 | Noguchi et al. | 123/139 AW |

FOREIGN PATENT DOCUMENTS

| | | | |
|---|---|---|---|
| 2,307,136 | 5/1976 | France | 123/139 AW |

*Primary Examiner*—Charles J. Myhre
*Assistant Examiner*—P. S. Lall
*Attorney, Agent, or Firm*—Edwin E. Greigg

[57] ABSTRACT

An air flow rate sensor, located in the indication tube of an internal combustion engine, displaces a fuel metering slide, thereby changing the fuel flow and the fuel pressure gradient. This pressure gradient is applied to a differential pressure valve which actuates a fuel flow control throttle until the pressure gradient has been restored to a nominal value, corresponding to a desired fuel-air ratio.

In a variant embodiment, an arbitrary change in the metered out fuel results in a fuel pressure gradient which is used to reset an air-flow control member until the nominal value of the pressure gradient has been restored, corresponding to a desired fuel-air ratio.

11 Claims, 3 Drawing Figures

FUEL-AIR-MIXTURES CONTROLLER FOR INTERNAL COMBUSTION ENGINES

This is a division of application Ser. No. 551,498, filed Feb. 20, 1975, now U.S. Pat. No. 4,015,571.

BACKGROUND OF THE INVENTION

The invention relates to a fuel-air ratio controller for use in an internal combustion engine including a device for measuring the air quantity aspirated by the engine (air measuring member) and including a fuel metering system.

In order to maintain a low level of emission of toxic components from internal combustion engines, a favorable fuel ratio must be maintained. This is true in the same degree for conventional, externally ignited engines as for engines employing stratified charge or self-ignition.

In the known fuel metering systems used with internal combustion engines, the command variable for maintaining the fuel-air ratio is either the air quantity provided to the engine or the fuel quantity provided to the engine, and the required complementary substance, i.e., either fuel or air, respectively, is metered out in accordance with the common variable. Thus, it is customary, in externally ignited internal combustion engines, to use the butterfly throttle valve in the induction tube, which arbitrarily determines the air quantity aspirated by the engine, to generate the command variable. In order to maintain the desired fuel-air mixture, this changeable air quantity is measured and a corresponding fuel quantity is allotted to it. If the air quantity changes, then the fuel quantity also changes. Metering errors, for example, those occurring when jets become clogged, cannot be controlled in such "direct control systems," so that very rapid build-ups of toxic emissions can occur of which the operator of the internal combustion engine is unaware until the engine performs poorly. In particular, in engines employing intermittent injection, the air flow rate is measured by measuring the induction tube pressure. Thus, the air quantity is not measured directly, but is determined via the air pressure and this leads to corresponding errors in the associated fuel metering process.

In self-igniting internal combustion engines, it is generally the fuel quantity which is changed arbitrarily and air is aspirated by the engine as required. This type of internal combustion engine usually operates with a large surplus of air and this can also lead to undesirable toxic emissions, because the excess air causes a particularly hot combustion process with a high level of nitrogen oxide emissions.

OBJECT AND SUMMARY OF INVENTION

It is a principal object of the invention to provide a fuel-air ratio control system of the type described above, which avoids the disadvantages cited above and which may be used irrespective of the type of the engine in which it is installed.

This object is attained according to the invention by providing means for comparing the aspirated air quantity and metered out fuel quantity in the control system in such a way that, when the fuel-air ratio departs from a predetermined nominal value, for example, that where $\lambda = 1$, the desired nominal value is automatically restored by an air control member and/or a fuel quantity control member. $\lambda$ is the so-called air number and a value of $\lambda = 1.0$ corresponds to a stoichiometric fuel-air mixture.

In this way, a correction takes place at any time when the mixture ratio departs from the desired nominal value which is chosen for low toxic emissions.

According to an advantageous feature of the invention, the fuel quantity provided to the engine flows to a fuel control member which is also actuated by the air measuring member and which produces a pressure gradient related to the air quantity and to the fuel quantity. This differential pressure is maintained equal to a nominal value, so that, when the pressure gradient is different from this nominal value, the fuel quantity or the air quantity provided to the engine is changed until the nominal value is restored.

A carburetor, or, for example, a high pressure injection pump, may be disposed downstream of the fuel control member. The critical condition is that the entire fuel quantity delivered to the engine is compared with the entire aspirated air quantity.

The invention will be better understood as well as further objects and advantages thereof will become more apparent from the ensuing detailed specification of two exemplary embodiments taken in conjunction with the drawing.

DESCRIPTION OF THE PREFERRED EMBODIMENTS

Figure 1:
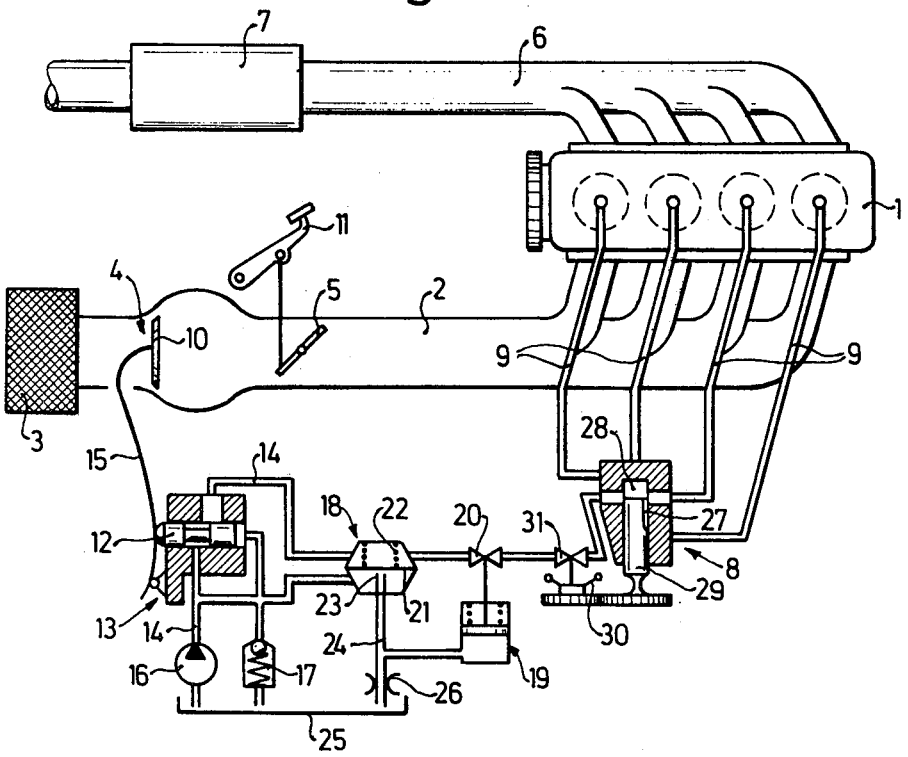
FIG. 1 shows the first exemplary embodiment of the invention in which the air is used as the command variable.

In both exemplary embodiments, the air is aspirated by the engine through an induction tube 2, a filter 3, an air quantity measuring member 4, and a throttle butterfly valve 5, constituting air control means 5. The exhaust gases of the engine 1 are led through an exhaust line 6 containing a muffler 7. The engine 1, which, in these examples, operates with self-ignition, is supplied with diesel fuel through lines 9 by a fuel injection pump 8. The fuel is injected directly into the engine's cylinders or into the pre-chambers of the cylinders.

In the exemplary embodiment shown in FIG. 1, the command variable (set-point variable) is the fresh air quantity which is determined by the position of the butterfly valve 5 and, to a certain degree, also by the engine rpm. For this purpose, the throttle valve 5 is immediately coupled to the gas pedal 11 of the vehicle. An air measuring member 4 actuates a valve slide 12 in a fuel metering valve 13 located in the suction line 14 of the fuel injection pump 8. The air measuring member, in this case, is a plate 10 disposed transversely to the air flow and mounted at one end of a pivoting lever 15 within the induction tube.

The pivoting lever 15 immediately actuates the slide 12 in opposition to a hydraulic restoring force produced by fluid which acts on the rear face of the slide 12 and which is supplied by a fuel supply pump 16 which also serves as the fuel delivery pump for the injection pump 8. A pressure control valve 17 keeps the restoring force constant.

Thus, the valve 13, which constitutes a first fuel control means, causes a pressure gradient in the suction line 14 which is a function of the aspirated fuel quantity as well as of the air quantity flowing through the induction tube. The deflection of the air measuring member and the resulting cross-sectional change at the valve 13 are preferably linearly related to avoid the necessity for corrective steps. Thus, if the pressure difference in the suction line 14 is changed by the valve 13, then the ratio of the air quantity to the fuel quantity is also changed. Therefore, the pressure difference is used as the controlled variable whose value defines a particular value of the ratio of the fuel quantity to the air quantity. For this purpose, the fuel pressures prevailing, respectively, ahead of and behind the valve 13, i.e., the pressures in line 14 on both sides of the valve 13, are fed to a differential pressure valve 18 which, in turn, controls a servo motor 19 that determines the fuel quantity delivered to the injection pump 8 by actuating a fuel metering member which, in the case of a serial injection pump would be, for example, the control rod. The exemplary embodiment of FIG. 1 has a suction throttle injection pump 8 in which the servo motor 19 controls the suction throttle valve 20, which constitutes a second fuel control means. In contrast to this example, cited to explain the invention, a simplified apparatus could be provided in which the fuel metering valve 13 was immediately used as the suction throttle. The servo motor is embodied as a hydraulic servo-motor, actuated by fluid whose pressure is determined by the differential pressure valve 18. The differential pressure valve 18 has a diaphragm 21 whose one side is actuated by the fuel pressure prevailing ahead of the valve 13 and whose other side is actuated by the fuel pressure prevailing behind the valve 13. To equalize the pressures, the chamber with the lower pressure contains a spring adding an additional force on the diaphragm 21. The opposite valve chamber, in which the higher pressure prevails, contains a fixed valve member 23 controlled by the diaphragm 21 which serves as the movable valve member. A line 24 leads from this chamber to the servo motor 19. It is advantageous to permit a part of the fuel delivered by the pump 16 to constantly flow through this line 24 back to the fuel container 25, and a throttle 26, located shortly ahead of the terminus of the line 24, is used to produce the desired pressure change for actuating the servo motor 19 when the flow cross section of the differential pressure valve 21, 23 is changed. The controlled variable, which is determined by the hydraulic restoring force present at the slide 12 as well as by the force of the spring 22 in the differential pressure valve, can be adjusted by changing these two forces, for example, depending on the engine temperature or on the atmospheric pressure, which would change the ratio of the fuel quantity to the air quantity. The pump 8 is an intermittent injection distribution pump which connects the suction line 14 to the pump working chamber 28 during each suction stroke. The reciprocating and simultaneously rotating distributor piston 29 delivers the fuel through a groove 27 to the individual fuel lines 9 and to the engine 1. The overall regulation of the pump can take place by a centrifugal force governor 30 controlling the valve 31 in the suction line of the pump.

When the gas pedal 11 changes the setting of the throttle butterfly valve 5 and thus changes the air quantity flowing to the engine, the position of the air measuring member 4 is also changed which, in turn, changes the pressure difference across the valve 13. This change of the controlled variable, i.e., of the set point value of the pressure difference, causes the differential pressure valve 18 to change the pressure in the servo motor 19 and hence causes a resetting of the suction throttle 20 of the injection pump 8. This resetting motion, in turn, causes a change in the fuel flow which is then again adapted in the desired ratio to the aspirated air quantity. In this manner, the injected fuel quantity is continuously compared with the aspirated air quantity and is servo-controlled to maintain a nominal value of the fuel-air ratio.

Figure 2:
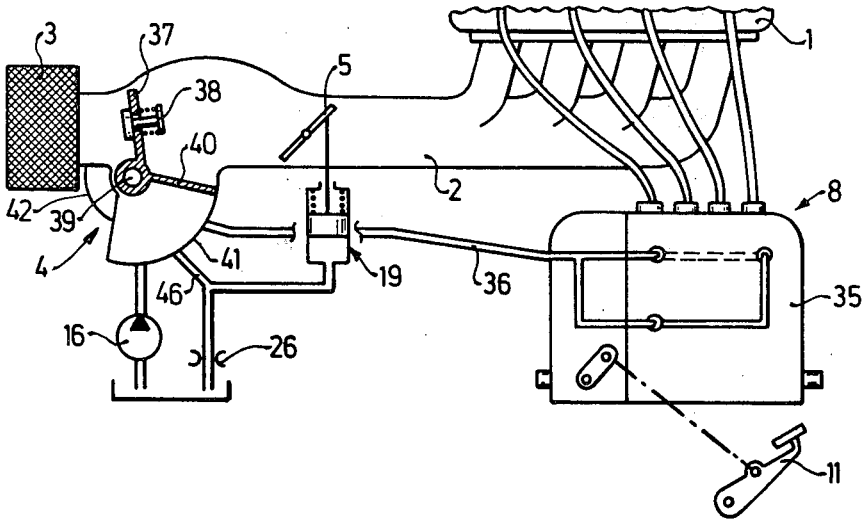
FIG. 2 depicts the second exemplary embodiment of the invention in which the engine fuel is used as the command variable.

The exemplary embodiment shown in FIG. 2 operates in principle in the same way as that shown in FIG. 1, with the difference, however, that the command variable (set-point variable) is the injected fuel quantity which is set by the gas pedal 11 and directly determines the amount of fuel injected by the injection pump 35. In this case, too, the aspirated air quantity is measured by an air flow meter 4 which changes the flow cross section of a fuel throttle valve shown in detail in FIG. 3, through which passes the fuel aspirated by the fuel injection pump 35 through the line 36 and which is then immediately injected into the internal combustion engine by the injection pump.

In this case, the air measuring member is a baffle plate 37, pivoted at one side of the induction tube 2 and provided with an excess pressure valve 38 to guard against possible reverse air surges. The baffle plate is carried on a shaft 39 and has a second wing portion 40 which travels with as little clearance as possible in a bulge 41 of the induction tube for the purpose of damping its motion. The bulge 41 is open in the direction of the induction tube downstream of the shaft 39.

Figure 3:
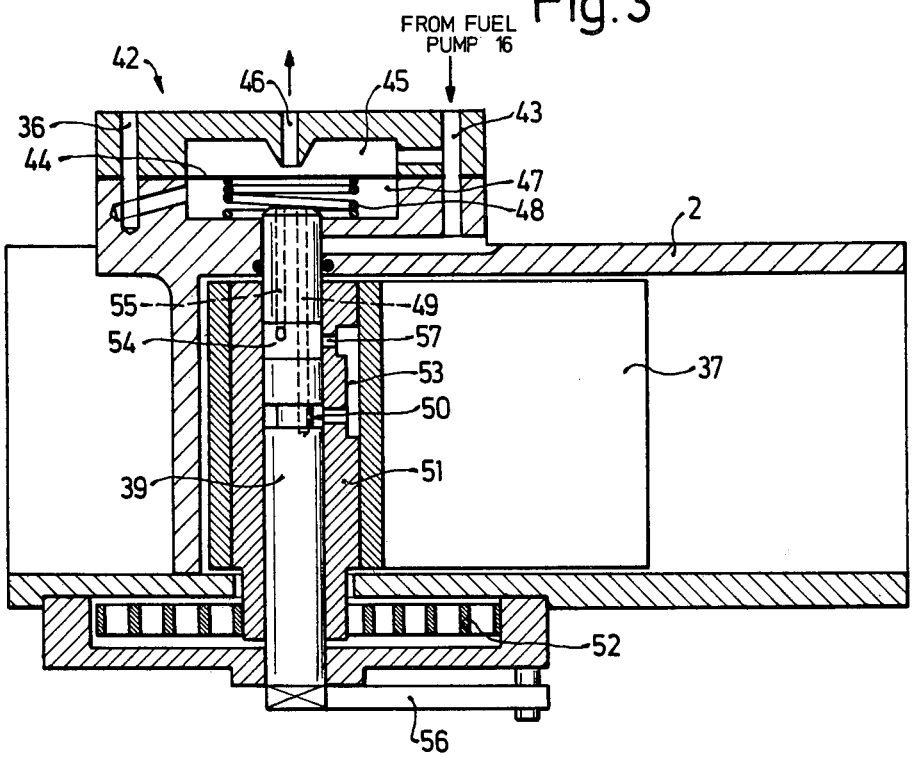
FIG. 3 is an enlarged, sectional representation of the air measuring member and the differential pressure valve of the second exemplary embodiment according to FIG. 2.

FIG. 3 is a section through the shaft 39 and a portion of the induction tube in enlarged scale compared with that of FIG. 2. Advantageously, the air measuring member 37 has a rectangular cross section so as to produce a linear relationship between its angle of rotation and the air quantity to be measured. A differential pressure valve 42, constituting a first fuel control means, is disposed coaxially with the baffle shaft 39 on the induction tube 2. Fluid delivered by the pump 16 flows through a channel 43 into a chamber 45 of the differential pressure valve 42, which is connected by a line 46 to the servo motor 19. The exit cross section of the line 46 is controlled by the diaphragm 44 whose other side, facing the chamber 47, is loaded by a spring 48. Fuel which does not flow through the line 46 flows from line 43 into a line 49, extending within the shaft 39 and thence flows into an annular groove, located on the surface of the baffle shaft 39. The air measuring baffle plate 37 itself is affixed to a hub 51 which is rotatably mounted on the shaft 39. A restoring spring 52, embodied as a spiral spring, engages the hub 51. Within the hub 51 extends a fuel channel 53 leading to a slot 57 which, together with recesses 54 in the outer circumference of the shaft 39, constitutes the fuel throttle valve whose throttling action has a linear relation to the air quantity. Fuel then flows through a channel 55 into the second chamber 47 of the differential pressure valve and thence to the suction channel 36 of the injection pump 35. A lever 56 permits turning the rotating shaft 39 and hence also permits changing the basic relative positions of the shaft 39 and the hub 51.

Thus, in the second exemplary embodiment as soon as the gas pedal 11 changes the injected fuel quantity, the resulting change of the differential pressure in the differential pressure valve 42 causes the servo-motor 19 to adjust the throttle valve 5 which changes the air quantity aspirated by the engine and deflects the air measuring member 4 which changes the differential pressure across the valve members 57, 54 until it again corresponds to the desired set point value. If it is necessary to distribute the injected fuel quantity to two different combustion chambers associated with a single piston of the engine, then a second injection pump may be connected downstream of the differential pressure valve and its suction volume is also compared by the differential pressure valve with the entire aspirated air quantity. The described mixture control system therefore always determines the overall ratio of fuel to air.

The invention is of special significance in the case of high-pressure fuel injection systems operating with intermittent injection. Especially in those engines which use the induction tube pressure as the command variable to actuate, for example, the pneumatic control of the injection pump, deviations from a desired fuel-air ratio can be quite large, one reason therefor being the nonlinear relationship between the air flow rate and the air pressure in the induction tube of the engine.

What is claimed is:

1. A fuel-air ratio regulator for an internal combustion engine that includes an air induction tube, a fuel injection pump and a primary fuel pump, comprising:

(a) an air quantity measuring member, disposed in said air induction tube;

(b) first fuel control means, disposed in the fuel line between said primary fuel pump and said fuel injection pump, and actuated by said air quantity measuring member; and (c) air flow control means, disposed in the induction tube and connected to the first fuel control means for actuation by said first fuel control means; whereby the air quantity aspirated by the engine is compared to the allotted fuel quantity and a desired fuel-air ratio is maintained automatically.

2. A fuel-air regulator as defined in claim 1, further comprising:

(d) means for arbitrary actuation of the fuel injection pump resulting in arbitrary control of the allotted fuel quantity;

and wherein said first fuel control means includes (ii) a servo motor, actuated by said first fuel control means and wherein said air flow control means is a throttle butterfly valve actuated by said servo motor.

3. A fuel-air ratio regulator as defined in claim 2, wherein said fuel injection pump includes means for automatic rpm control.

4. A fuel-air ratio regulator as defined in claim 1, wherein said first fuel control means includes (i) a fuel valve with a movable valve member actuated by said air quantity measuring member; whereby motions of said movable valve member tend to produce changes in the pressure gradient across said fuel valve which are counteracted by said air flow control means.

5. A fuel-air ratio regulator as defined in claim 4, wherein the flow cross section of said fuel valve corresponds to the air quantity aspirated by the engine and wherein said first fuel control means further includes:

(ii) a differential pressure valve, connected upstream and downstream of said fuel valve; and (iii) a servo motor, actuated by said fuel valve and connected to influence said air flow control means.

6. A fuel-air ratio regulator as defined in claim 5, wherein said air quantity measuring member is a baffle plate, disposed transversely in the induction tube and pivotably attached at one side to a shaft mounted on the induction tube and wherein the pivotal axis of said baffle plate defines a first and a second portion thereof, said first portion moving substantially within the longitudinal extent of said induction tube and said second portion moving substantially within an outwardly bulging portion of said induction tube, thereby damping the pivotal motions of said baffle plate.

7. A fuel-air ratio regulator as defined in claim 6, wherein said baffle plate has a hub which surrounds said shaft and is associated therewith for relative rotation, and which includes fuel channels, and wherein said shaft also includes fuel channels which cooperate with said fuel channels in said hub, thereby producing a variable pressure difference.

8. A fuel-air regulator as defined in claim 7, wherein said differential pressure valve has a diaphragm, dividing it into two chambers one of which is connected to the fuel line upstream of said fuel valve and includes a valve seat which may be obturated by said diaphragm, whereas the other chamber is connected to the fuel line downstream of said fuel valve and contains a spring which urges said diaphragm to obturate said valve seat.

9. A fuel-air ratio regulator as defined in claim 8, wherein said servo motor is a hydraulic servo motor.

10. In an internal combustion engine employing stratified charge fuel delivery and including an air induction tube, at least one fuel injection pump and a primary fuel pump, the combination comprising:

(a) an air quantity measuring member, disposed in said air induction tube;

(b) first fuel control means, disposed in the fuel line between said primary fuel pump and said fuel injection pump, and actuated by said air quantity measuring member; and (c) air flow control means, disposed in the induction tube and connected to the first fuel control means for actuation by said first fuel control means; whereby the air quantity aspirated by the engine is compared to the allotted fuel quantity and a desired fuel-air ratio is maintained automatically.

11. In an internal combustion engine employing self-ignition and including an air induction tube, a fuel injection pump and a primary fuel pump, the combination comprising:

(a) an air quantity measuring member, disposed in said air induction tube;

(b) first fuel control means, disposed in the fuel line between said primary fuel pump and said fuel injection pump, and actuated by said air quantity measuring member; and (c) air flow control means, disposed in the induction tube and connected to the first fuel control means for actuation by said first fuel control means; whereby the air quantity aspirated by the engine is compared to the allotted fuel quantity and a desired fuel-air ratio is maintained automatically.

* * * * *